US006825426B2

(12) United States Patent
Muench et al.

(10) Patent No.: US 6,825,426 B2
(45) Date of Patent: Nov. 30, 2004

(54) MAKE-BEFORE-BREAK SELECTOR SWITCH

(75) Inventors: Frank John Muench, Waukesha, WI (US); Patrick Harold Pride, Mukwonago, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/406,570

(22) Filed: Apr. 4, 2003

(65) Prior Publication Data

US 2004/0094394 A1 May 20, 2004

Related U.S. Application Data

(63) Continuation-in-part of application No. 10/262,063, filed on Oct. 2, 2002, now abandoned.

(51) Int. Cl.[7] ..... H01H 19/58
(52) U.S. Cl. ..... 200/11 R; 200/11 TC
(58) Field of Search ..... 200/16 R–16 F, 200/11 R–1 V, 11 TC

(56) References Cited

U.S. PATENT DOCUMENTS

| | | | | |
|---|---|---|---|---|
| 1,804,647 A | | 5/1931 | Schuster | |
| 2,231,598 A | | 2/1941 | Shroyer | |
| 2,231,627 A | | 2/1941 | Jansen | |
| 2,528,548 A | | 11/1950 | Reilly | |
| 2,751,447 A | | 6/1956 | Bartlettt et al. | |
| 2,918,541 A | | 12/1959 | Waite | |
| 3,366,763 A | * | 1/1968 | Bleibtreu et al. | 200/11 TC |
| 3,764,891 A | | 10/1973 | Lingenfelter et al. | |
| 3,903,382 A | * | 9/1975 | Silbermann | 200/11 TC |
| 3,922,509 A | | 11/1975 | Bryceland | |
| 4,130,789 A | * | 12/1978 | Neumann | 323/340 |
| 4,300,028 A | | 11/1981 | Cronin et al. | |
| 4,317,972 A | | 3/1982 | Kjellberg | |
| 4,412,116 A | * | 10/1983 | Golub | 200/571 |
| 4,446,343 A | * | 5/1984 | Golub et al. | 200/11 TC |
| 4,532,386 A | * | 7/1985 | Muench et al. | 200/11 TC |
| 4,554,420 A | * | 11/1985 | Golub | 200/11 TC |
| 4,559,421 A | | 12/1985 | Lapke et al. | |
| 4,959,554 A | | 9/1990 | Underwood, IV et al. | |
| 5,021,615 A | * | 6/1991 | Muench et al. | 200/11 TC |
| 5,216,574 A | | 6/1993 | Marmonier | |
| 5,786,552 A | * | 7/1998 | Dohnal et al. | 200/11 TC |
| 5,834,717 A | * | 11/1998 | Neumeyer et al. | 200/17 R |
| 5,847,939 A | * | 12/1998 | Cotton | 361/836 |

FOREIGN PATENT DOCUMENTS

| | | |
|---|---|---|
| EP | 0 160 555 | 3/1993 |
| GB | 2 040 576 | 8/1980 |

OTHER PUBLICATIONS

Cooper Power Systems, Sectionalizing Switches Electrical Apparatus 800–64, pp. 1–5, Jan. 1990.

* cited by examiner

*Primary Examiner*—Elvin Enad
*Assistant Examiner*—Lisa Klaus
(74) *Attorney, Agent, or Firm*—Fish & Richardson P.C.

(57) ABSTRACT

A make-before-break selector switch for use in high-voltage applications allows power to a load to be switched from a first power source to a second power source such that the second connection is made before the first is broken. The selector switch includes a blade coupled to a selector switch control such that the blade may be placed in a first position to electrically couple a first power source electrical contact to a load electrical contact and in a second position to electrically couple a second power source electrical contact to the load electrical contact. T-shaped and v-shaped blade implementations are examples of configurations that may be used.

20 Claims, 7 Drawing Sheets

MAKE-BEFORE-BREAK SELECTOR SWITCH

CROSS REFERENCE TO RELATED APPLICATION

This application is a continuation-in-part of U.S. patent application Ser. No. 10/262,063, filed Oct. 2, 2002, now abandoned, and titled "MAKE-BEFORE-BREAK SELECTOR SWITCH," which is incorporated by reference.

TECHNICAL FIELD

This description is directed to an electrical selector switch, and more particularly to a make-before-break selector switch suitable for high-voltage applications. For the purpose of this document, high voltage is defined as voltages higher than 1,000 volts.

BACKGROUND

Selector switches, which may be referred to as sectionalizing or four-position loadbreak switches, are used in high voltage operations to electrically connect one or more power sources to a load circuit. For example, electrical utilities have used selector switches in underground single phase networks and in three-phase commercial and industrial networks. One use of these devices is to switch between alternate power sources to allow, for example, reconfiguration of a power distribution system or use of a temporary power source while a main power source is serviced. The desirability of avoiding interruptions in power to customers when switching between alternate power sources has increased with the increased use of computers and electronics. Even a momentary interruption when switching power to perform routine maintenance on a circuit can create substantial problems in a computer data center, such as causing loss of data, system failures, and computer service outages.

Before the advent and wide-spread use of computing devices, electric customers typically were not adversely affected by a momentary power outage or a fluctuation in supply current. Now, many companies rely on complex computer systems for their day-to-day operations; often with little more than a surge protector to secure their valuable data against power outages or fluctuations. Because of this, many customers are extremely sensitive to any irregularities in their electrical supply.

The power distribution systems used to supply power change as customers' demands and requirements change. For example, an electric utility providing power to a large office building typically needs to reconfigure the power distribution to and within the office building when customers move, rebuild space, and add secondary or alternate power feeds. Additionally, power distribution systems may be reconfigured to perform routine maintenance or to replace damaged components. Using conventional selector switches, an electric utility must momentarily disconnect power feeds when reconfiguring a power distribution system.

SUMMARY

Selector switches typically are composed of several subassemblies. One subassembly is the switch block, which is generally triangular in shape, with a place to mount contacts to each of the corners of the switch. These corners are at 90° angles from each other. The block supports all of the structures and maintains required spacing and separation between parts. Fixed contacts are mounted to the switch block at two or all three of the block's corners. These contacts usually are connected to power lines and/or taps that are connected to radial feeders or directly to electrical distribution devices such as transformers.

Another subassembly is a rotating center shaft to which blades are mounted. Typically, these blades rotate in 90° increments as the switch mechanism causes the shaft to rotate. There also may be center hub that mounts to the blade and one of the contact positions on the switch block.

There are several variations of switch that can be made from these components. Two of the more common configurations are known as a "V" blade switch and a "T" blade switch. For a "V" blade switch, the blade has two members of the same length and typically at a 90° angle from each other. Two of the contacts that are mounted to the switch block may be connected to a first power source and a second power source. The center hub is connected to a radial feeder or to an electrical distribution device such as a transformer. The hub may also be connected to a third power source or to a tap that carries power to a feeder serving several transformers.

With a "V" blade and a center hub, the user has four switch positions available. The first position connects the hub and tap (or line connected to the hub) to the first source of power; the second position connects the two sources to each other and the hub. The third position connects the second line to the hub and the fourth is a completely open configuration with none of the lines connected to any of the other lines.

The "T" blade has three members, each typically at a 90° angle from each other. The switch configured as a "T" has fixed contacts at each of three corners of the switch block. A line or tap may be connected to each of these contacts. With this switch blade configuration, the four positions typically connect 1) the first power source to the tap, 2) both power sources to the tap, 3) the second power source to the tap and 4) the two sources together, with no connection to the tap.

Rotating a handle connected to the mechanism can change the connections. The rotation charges and then releases springs that cause the switch shaft and blades to rotate at a speed independent of the rotating speed of the handle. With a make-before-break-version of the switch, each of the projecting legs is bridged by a perimeter contact tie that connects the end of each leg to the other.

The perimeter electrical contact is sized such that, when the selector switch control is moved from the first position to the second position, the coupling of the first power source electrical contact to the load electrical contact is not broken until the coupling of the second power source electrical contact to the load electrical contact is made. As such, the switch provides make-before-break functionality in that a first connection is not broken until after a second connection has been made.

The blade of the make-before-break selector switch may be in essentially a V-shaped configuration, and may include a second insulated arm connecting the perimeter electrical contact, which may be configured essentially as a quarter-circle arc, to the mounting point. Additionally, the blade may be in an essentially T-shaped configuration that, for example, includes a second insulated arm and a third insulated arm, each connecting the perimeter electrical contact, which may be configured as an essentially half-circle arc, to the mounting point. The blade also could have a single arm that ties the perimeter contact to the hub.

In another general aspect, a make-before-break selector switch assembly for use in high-voltage applications includes a switch casing, a selector switch mechanism and operating handle and electrical contacts (including first, second, and/or third electrical contacts), and a make-before-break selector switch blade component. The switch casing may be submersed in an insulating fluid that may include, for example, base ingredients such as mineral oils or vegetable oils, synthetic fluids such as polyol esters, SF6 gas, and silicone fluids, and mixtures of the same.

The details of one or more implementations are set forth in the accompanying drawings and the descriptions below. Other features will be apparent from the descriptions and drawings, and from the claims.

DETAILED DESCRIPTION

Figure 1A:
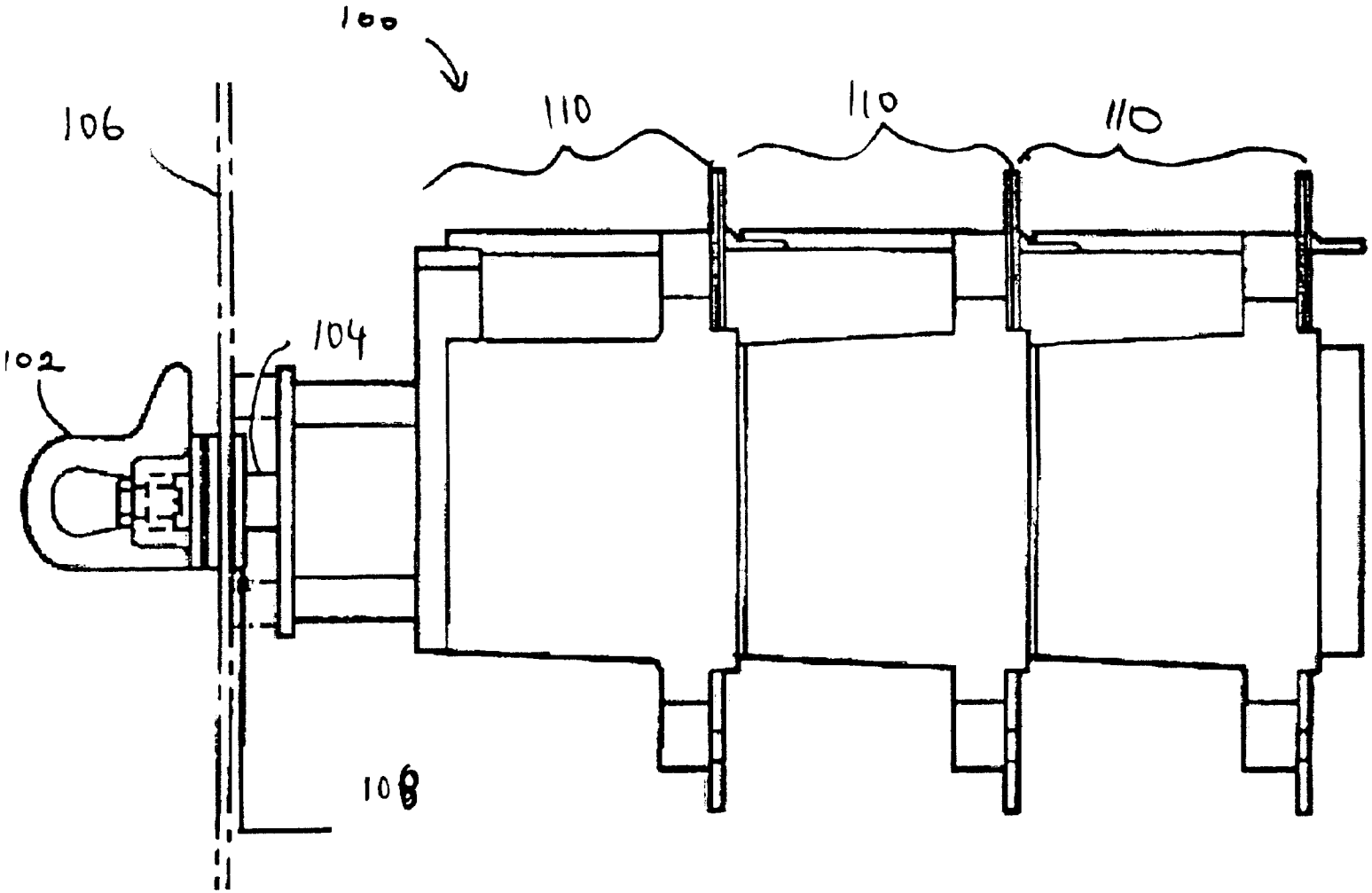
FIG. 1A is a side elevational view of a make-before-break selector switch.

Selector switches (also called three-or four-position sectionalizing or loadbreak switches) have been used in high-voltage applications primarily because of their economics, flexibility, ease of installation, compactness, and operational performance. Selector switches may be found in a broad range of configurations including V-blade and T-blade configurations, as well as others, such as single-blade selector switches.

With a V-blade configuration, a selector switch may be used to feed a radial feeder tap or a load from one of two sources or from both sources at the same time, and may provide a completely open position in which the load side is connected to neither source. This effectively provides the functionality of two on/off switches, with a simpler installation in a transformer or switchgear. Such a selector switch needs only one tank hole and eliminates the leads needed to tie the two switches together inside the transformer or switchgear. Due to the lead elimination, two current interchanges per phase may be eliminated.

With a T-blade configuration, a selector switch may be used to feed a radial feeder tap or a load from one of two sources or from both sources at the same time, or may tie the two sources together with the load connected to neither source. The same simple lead connection and installation methods used with V-blade selector switches as described above may be used with T-blade selector switches. Various additional configurations may be used, including a 1-blade selector switch and a 1-blade on/off switch if needed by a particular application.

A selector switch typically includes a handle on the outside of the tank designed to point to position markings indicative of what is being connected or disconnected. For example, a selector switch may be used within a high-voltage transformer tank filled with an insulating fluid that may include, for example, base ingredients such as mineral oils or vegetable oils, synthetic fluids such as polyol esters, SF6 gas, and silicone fluids, and mixtures of the same.

When using such a selector switch, an operator can see clearly what is being connected or disconnected by having the handle or similar position indicator of the switch point to position markings on the outside of the transformer tank.

A selector switch may also be designed to be operated with an extension tool or a remote, insulated operating tool, such as a shotgun or a hotstick. Such a tool mates with a switch handle and is turned by the operator to cause the switch to move from one of its four positions to an adjacent position.

Rotating the handle charges the spring mechanism to cause a selector switch to index from one position to the next. In previous designs, this resulted in momentary interruption as the switch interrupted the current flow from one contact before reestablishing the current flow by making connection with the next contact. Before widespread use of computers, this momentary interruption created very few problems. However, in today's computerized world, this instantaneous interruption can cause a loss of data in a computer or an interruption of a complex manufacturing process controlled by a computer, with recovery from the interruption often being expensive and difficult to achieve.

In many cases while actuating a high voltage selector switch, an electric utility is only changing a source that feeds a transformer or tap so that the sources can be maintained or so that customers can be added. One option is to use two on/off switches. Using two switches, an operator can close a second switch before switching open the first switch. This allows the circuit to be "made" before it is "broken."

There are situations where it is desirable to break the circuit before making a connection with a new power source. For example, when a system fault occurs on one feeder, tying two feeders together could connect the fault to the alternate power source. This could further damage the system and/or cause the upstream protective equipment, such as fuses, to also operate on both sources and thereby increase the size of the outage.

A make-before-break selector switch may be provided to allow the circuits to remain connected during the switching operation, if that is desired. If an operator desires to disable make-before-break functionality, the switch may be moved through an open position to prevent an operable power feed from being damaged by being connected to a damaged feed.

Referring to FIG. 1A, a make-before-break selector switch 100 includes a handle 102 connected to a shaft 104 that protrudes through a tank wall 106. The selector switch 100 may be immersed in an insulating fluid that may include, for example, base ingredients such as mineral oils or vegetable oils, and synthetic fluids such as polyol esters, SF6 gas, and silicone fluids, and mixtures of the same inside a transformer tank, and may be installed in switchgear or in a transformer near the ore/coil assembly. Selector switch 100 may be used to switch between alternative power sources in high-voltage applications.

Selector switch 100 includes one or more switch components 110. Each switch component 110 is operable to selectively complete a circuit between various contacts as described below with reference to FIGS. 3A and 3B. A switch handle 102 is operable to rotate shaft 104 to actuate one or more of the switch components 110.

For example, a selector switch 100 may be used to switch between two three-phase power sources. A selector switch 100 may include three switch components 110, with each switch component 110 used for a single phase. Thus, a first switch component 110 may alternatively select between the first phase of two different power sources, a second switch component 110 may alternatively select between the second phase of the two power sources, and a third switch component 110 may alternatively select between the last phase of the two power sources. Each of the switch components 110 may be connected such that shaft 104 may actuate all three of the switch components 110 simultaneously. This allows switching from the three phases of the first power source to the three phases of the second power source simultaneously. Shaft 104 may extend through each of the switch components 110 or each switch component may include a separate actuator configured such that the operation of shaft 104 actuates each of the switch components 110.

Figure 1B:
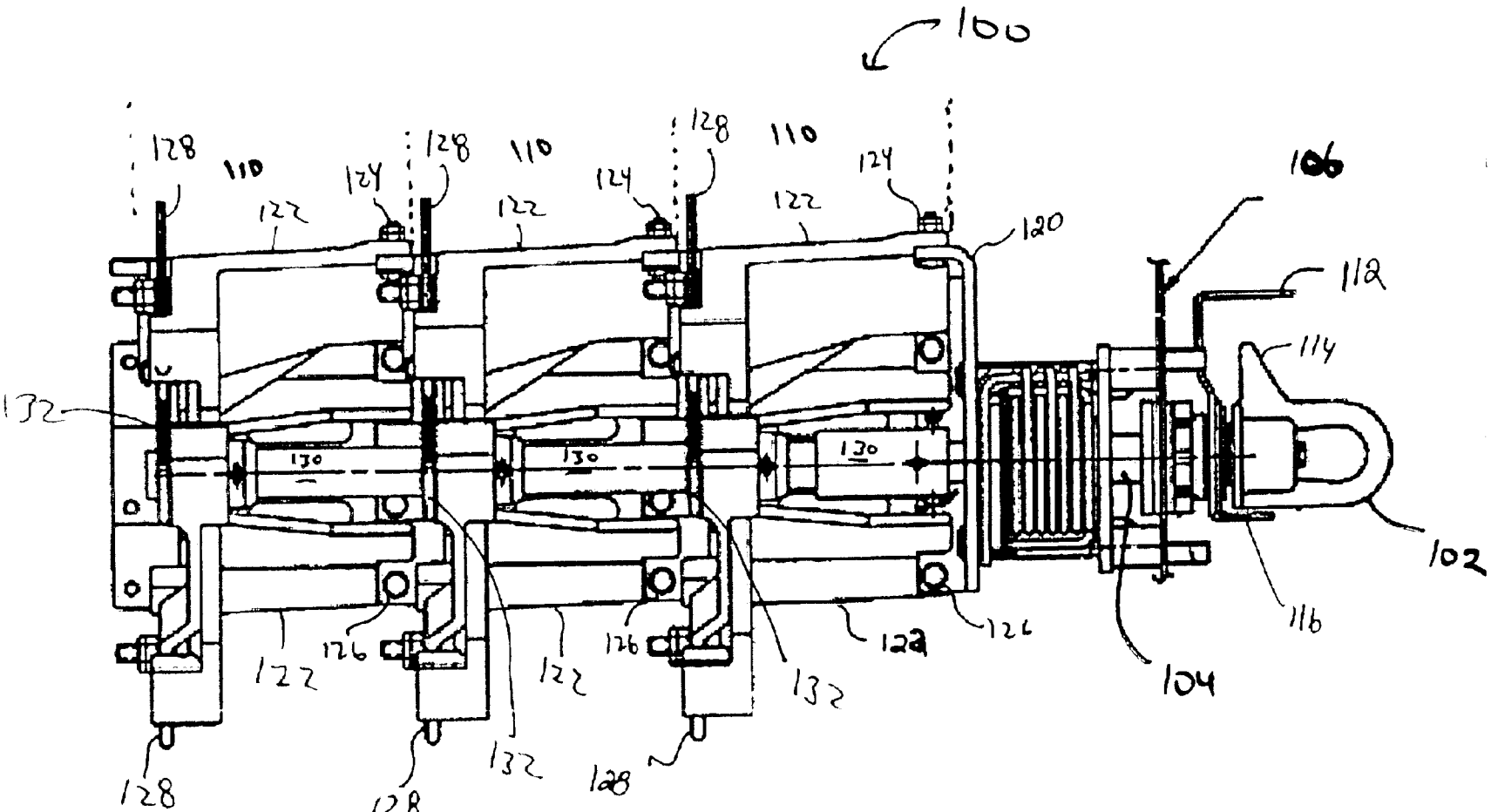
FIG. 1B is a side cross-sectional view of the make-before-break selector switch of FIG. 1A.

FIG. 1B provides a cut-away schematic of the selector switch 100 that illustrates the design and operation of exemplary switch components 110. Handle 102 is connected to shaft 104 which longitudinally extends to switch component 110. If desired, a limit plate 112 may be used to prevent handle 102 from rotating outside a fixed range. As handle 102 rotates to the limit of the fixed range, flange 114 hits stop mechanism 116 of limit plate 112.

In the implementation shown in FIG. 1A, the handle 102 may be rotated 360 degrees and allows a user to switch between two power sources or to create an open circuit. In some implementations, it is desirable to provide a selector switch 100 that can only select between two power sources, without allowing a user to create an open circuit. The limit plate 112 may be set to only permit the handle 102 to rotate such that either a first power source or a second power source is selected, and to prevent the handle from rotating to the open circuit position.

Selector switch 100 includes one or more switch components 110. In the illustrated implementation, a first switch component 110 is attached to end plate 120 using one or more bolts 124 and 126. Each switch component 110 includes one or more electrical contacts 128 for attaching power sources to the selector switch 100. A switch component shaft 130 is coupled to shaft 104 such that switch component shaft 130 rotates with shaft 104. A blade 132 is coupled to rotate with switch component shaft 130.

Figure 2A:
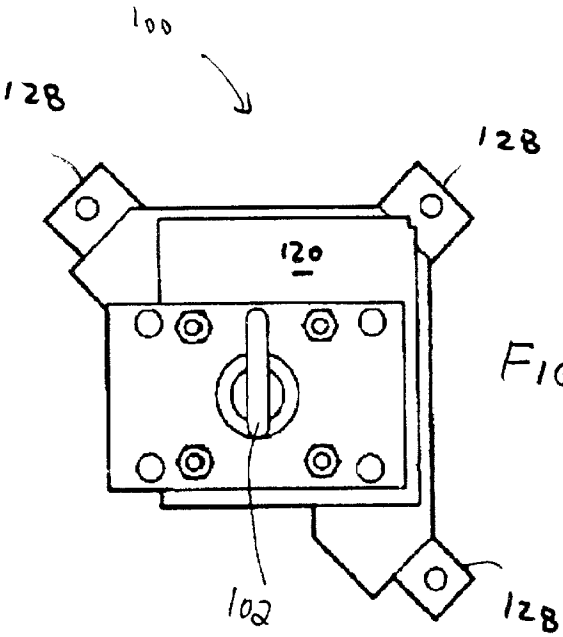
FIG. 2A is a front elevational view of the make-before-break selector switch of FIG. 1A.
Figure 2B:
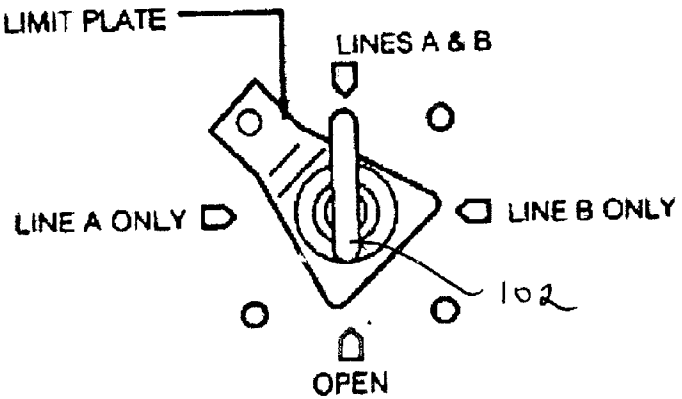
FIG. 2B is a front elevational view of the make-before-break selector switch of FIG. 1A with an attached limit plate.

FIGS. 2A and 2B provide an end view of selector switch 100 that shows handle 102, end plate 120, and three electrical contacts 128. Handle 102 may be turned to electrically couple various combinations of electrical contacts 128. Some implementations may include three electrical contacts 128 such as shown in FIG. 2A. Two of the electrical contacts 128 are connected to power sources (lines A and B), and one electrical contact 128 connected to a load. As shown in FIG. 2B, handle 102 may be rotated to selectively connect power sources to the load. In this implementation, the switch may be used to electrically couple the electrical contacts 128 as follows: (1) lines A and B to the load; (2) line A to the load; (3) line B to the load; or (4) an open circuit.

Various switch configurations may be formed by varying the switch selector blade and by restricting the 360 degree movement of shaft 104. For example, referring to FIG. 3A, selector blade 302 is a straight blade that may be used to open or close a circuit between contacts A and B. As the selector blade 302 is rotated normally, the blade opens and closes a circuit between contacts A and B. Contacts A, B, and C may correspond to contacts within selector switch 100, such as, for example, electrical contacts 128.

Figures 3A, 3B, 3C:
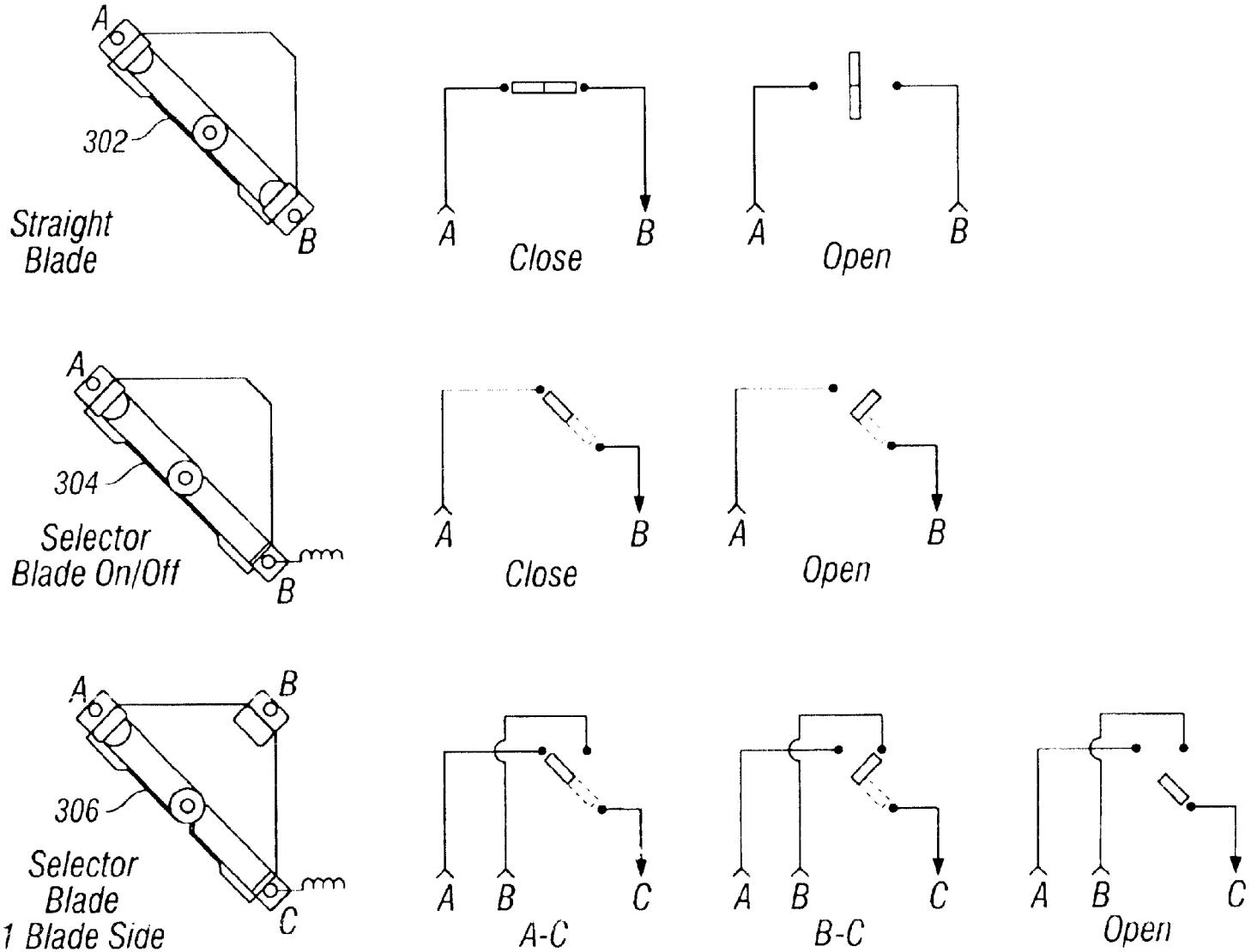
FIGS. 3A-3C are schematic diagrams of the positions of a straight-blade selector switch.

As shown in FIG. 3B, blade selector 304 includes a permanent connection to contact B and a rotatable portion that is operable to complete or open a circuit between contact A and contact B. As shown in FIG. 3C, blade selector 306 adds to the capabilities of blade selector 304 by allowing the selection of a circuit between contacts A and C, a circuit between contacts B and C, and an open circuit. This allows alternate power sources to be selected for powering a load at contact C.

Figures 3D, 3E, 3F:
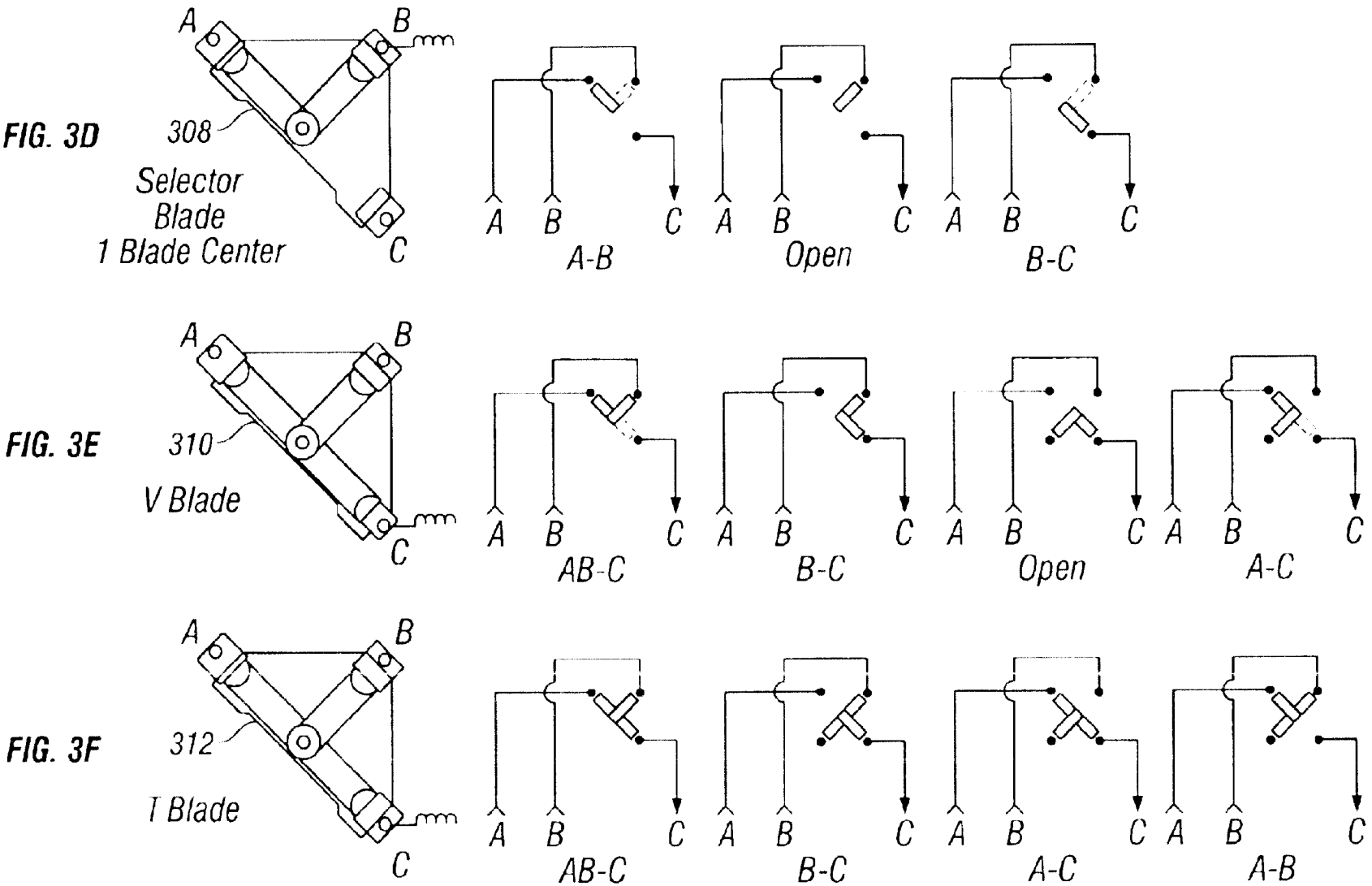
FIGS. 3D-3F are schematic diagrams of the positions of T-blade and V-blade selector switches.

Referring to FIG. 3D, blade selector 308 includes a permanent connection to contact B and is used to complete a circuit between contacts A and B or contacts B and C. Additionally, blade selector 308 permits the selection of an open circuit.

As shown in FIG. 3E, blade selector 310 includes a V-shaped blade and a permanent connection to contact C. This allows selection of an open circuit; a circuit between contacts A and C; a circuit between contacts B and C; or a circuit between contacts A, B, and C.

As shown in FIG. 3F, blade selector 312 includes a T-shaped blade that may be used to form circuits between contacts A and B; contacts A and C; contacts B and C; or contacts A, B, and C.

Figure 4B:
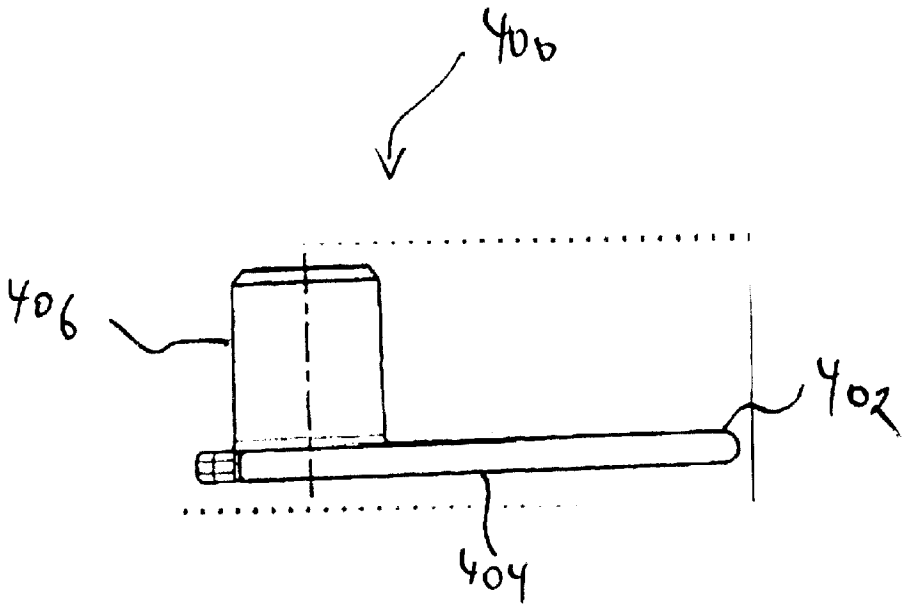
FIG. 4B is a side elevational view of the V-blade selector for use in the make-before-break selector switch of FIG. 1A.
Figure 4A:
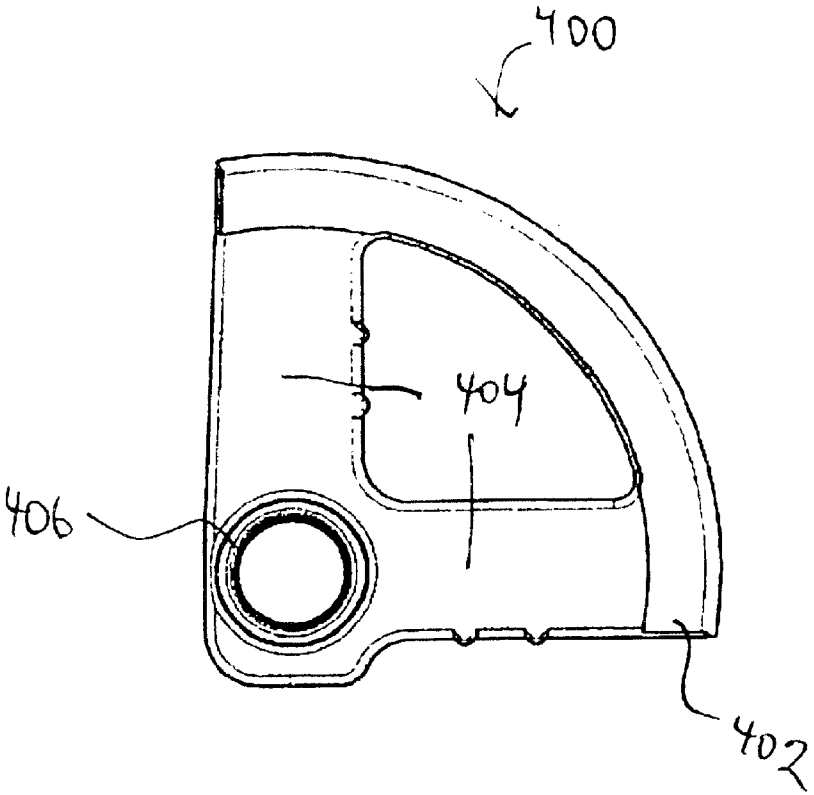
FIG. 4A is a plan view of a V-blade selector for use in the make-before-break selector switch.

Referring to FIGS. 4A and 4B, a make-before-break V-shaped blade 400 includes a perimeter contact 402, an insulator arm 404, and a mount 406. The blade is similar to selector blade 310 in FIG. 3E. However, selector blade 400 is shaped so that an alternate source may be selected without interrupting the power supply to a tap or load. V-shaped blade 400 may be used, for example, in any high-voltage application in which a power source for a particular tap or load needs to be switchable.

For example, a make-before-break selector switch using a V-shaped blade 400 may be used in a circuit that provides power to a company to power a computer server room. Power may be run to the computer server room transformer from two different high voltage sources. The V-shaped blade 400 may be placed in one position to turn off power to the computer server room transformer, in another position to complete a circuit to the first power source, and in a final position to complete a circuit to the second power source. The make-before-break selector switch allows the power source to be switched without interruption of the power supplied to the computer server room transformer.

A make-before-break selector switch with a V-shaped blade 400 may also be used in a switchgear or a transformer to select between two power sources. This could be used to isolate a portion of a power system for repair, upgrade, or maintenance without interrupting service to customers. In some cases, problems with a power source may make it undesirable to make a connection with another power source before breaking the connection with the faulted power source. The implementation shown in FIGS. 4A and 4B may be used to support break-before-make functionality by rotating the selector blade in the opposite direction such that the perimeter contact breaks the connection to the load electrical contact before completing the connection to a second power source.

The make-before-break selector switch may include multiple selector switch components. For example, a make-before-break selector switch for use in three-phase power systems may include a separate switch component for each power phase. The first component includes connections to the first phase of each source and the feeder tap or load. The second component includes connections to the second phase of each source and the feeder tap or load. Finally, the third component includes connections to the third phase of each source and the feeder tap or load.

Figure 5B:
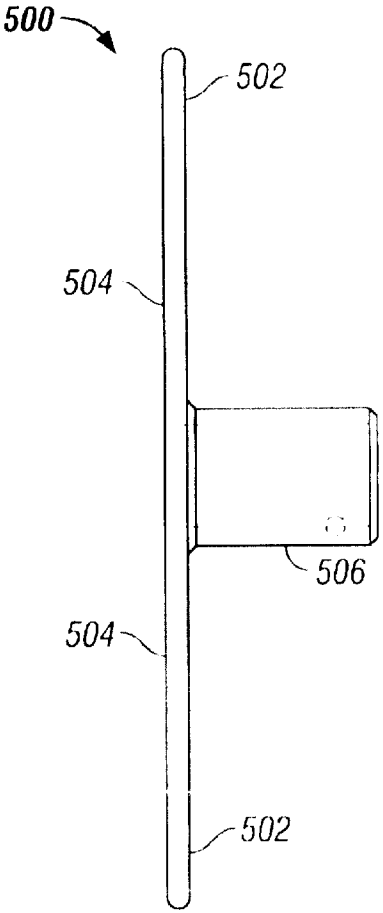
FIG. 5B is a side elevational view of the T-blade selector for use in the make-before-break selector switch of FIG. 1A.
Figure 5A:
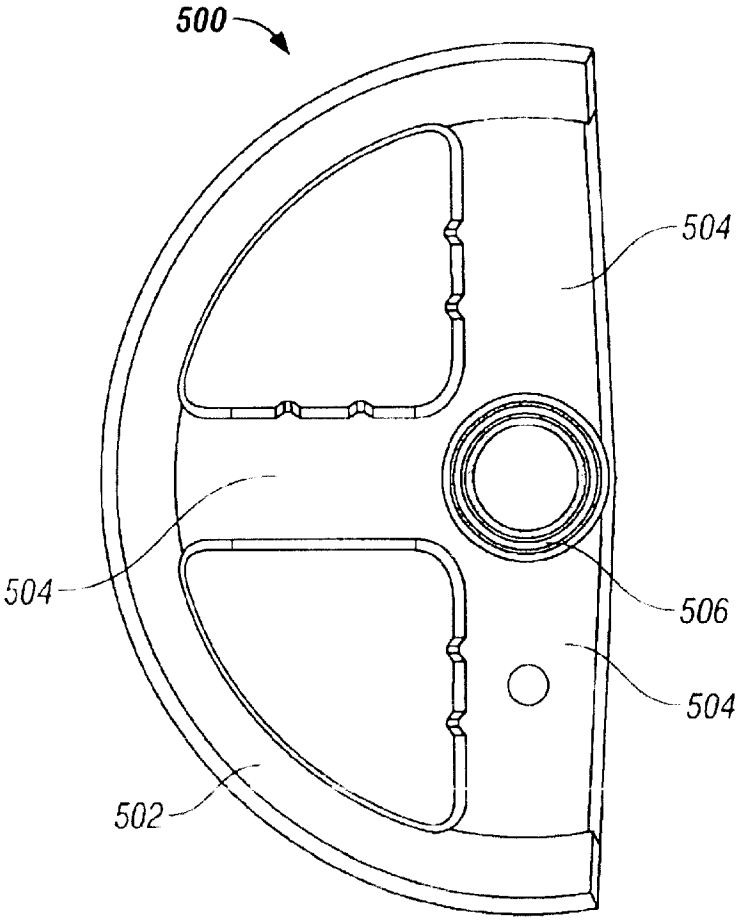
FIG. 5A is a plan view of a T-blade selector for use in a make-before-break selector switch.

Referring to FIGS. 5A and 5B, a make-before-break T-shaped blade 500 includes perimeter contact 502, insulator arm 504, and mount 506. The T-shaped blade 500 can implement the switching capability described with respect to FIG. 3B with the added make-before-break functionality. The perimeter contact 502 is semi-circular and sized such that it can electrically couple three contacts before breaking a previous connection. For example, in a switch with three contacts (A, B, and C), the T-shaped blade 500 may be actuated to complete a connection between all three contacts, or between any two of the three contacts.

Insulation may be added to the blades to prevent the electrical arc that may result during switching from "walking down" the blade to the hub. Without this insulation, the arc may not be interrupted at the elevated voltages required for this switch. For example, self-amalgamating materials may be used to insulate the blade so as to prevent arcs from walking down the blade to the hub.

Additional implementations may include blades with perimeter contacts covering a larger or smaller arc than those described as well as blades with multiple perimeter contact segments. For example, a blade could include two perimeter contacts similar to the perimeter contact described with respect to the v-shaped implementation above.

Another configuration could include a switch with contacts at more than one level. In this case, the leads would be connected to the contacts on one level and the tap connected to another level. The leads would be interconnected in a make-before-break manner, as would the taps. This would eliminate the need for a center hub but would require additional h separation and clearance. Again the key element remains the perimeter contact blade that bridges the fixed, block mounted contacts of the switch.

A number of implementations have been described. Nevertheless, it will be understood that various modifications may be made. Accordingly, other implementations are within the scope of the following claims.

What is claimed is:

1. A make-before-break selector switch for use in high-voltage applications, the switch comprising:

a first power source electrical contact;

a second power source electrical contact;

a load electrical contact;

a selector switch control mechanism; and a blade coupled to the selector switch control mechanism such that the blade is moveable between a first position that electrically couples the first power source electrical contact to the load electrical contact and in second position that electrically couples the second power source electrical contact to the load electrical contact, the blade comprising:

a mounting point used to couple the blade to the selector switch control; and an electrical contact sized such that, when the selector switch control mechanism causes the blade to be moved from the first position to the second position in a first direction, the coupling of the first power source electrical contact to the load electrical contact is not broken until the coupling of the second power source electrical contact to the load electrical contact is made.

2. The make before break selector switch of claim 1 wherein the arm of the blade has an insulated covering on the members that contact the electrical contact to the mounting point.

3. The make-before-break selector switch of claim 1 wherein the blade is in a V-shaped configuration.

4. The make-before-break selector switch of claim 3 wherein the blade in a V-shaped configuration includes a second arm having an insulated covering on the members that connect the electrical contact to the mounting point.

5. The make-before-break selector switch of claim 3 wherein the electrical contact is configured as a quarter-circle arc.

6. The make-before break selector switch of claim 1 wherein the blade is in a T-shaped configuration.

7. The make-before-break selector switch of claim 6 wherein the electrical contact is configured as a half-circle arc.

8. The make-before-break selector switch of claim 1 wherein the switch is configured to operate normally in response to voltages in excess of 1000 volts between the first power source electrical contact and the load electrical contact.

9. The make-before-break selector switch of claim 1 wherein the blade is coupled to the selector switch control mechanism such that the blade may be placed in a third position in which the load electrical contact is not coupled to the first power source electrical contact or the second power source electrical contact.

10. A make-before-break selector switch for use in high-voltage applications comprising:

a switch casing;

a selector switch control;

at least three electrical contacts including a first electrical contact, a second electrical contact, and a third electrical contact; and a make-before-break selector switch component operable to electrically couple the first electrical contact to the second electrical contact when placed in a first position and operable to electrically couple the first electrical contact to the third electrical contact when placed in a second position;

wherein the make-before-break selector switch component is moveable from the first position to the second position such that the electrical coupling between the first electrical contact and the second electrical contact is not broken before the electrical coupling between the first electrical contact and the third electrical contact is made.

11. The make-before-break selector switch of claim 10 wherein the switch casing is submersible in an insulating fluid.

12. The make-before-break selector switch of claim 11 wherein the switch is configured to operate normally in response to voltages in excess of 1000 volts between the first electrical contact and the second electrical contact.

13. The make-before-break selector switch of claim 10 wherein the insulating fluid comprises a vegetable oil.

14. The make-before-break selector switch of claim 10 wherein the selector switch control is a handle.

15. The make-before-break selector switch of claim 10 wherein the make-before-break selector switch component includes a blade coupled to the selector switch control, the blade comprising:

a mounting point used to couple the blade to the selector switch control;

an electrical contact; and an insulated arm connecting the electrical contact to the mounting point.

16. The make-before-break selector switch of claim 15 wherein the blade is V-shaped.

17. The make-before-break selector switch of claim 16 wherein the blade includes a second insulated arm connecting the electrical contact to the mounting point.

18. The make-before-break selector switch of claim 15 wherein the electrical contact is configured as a quarter-circle arc.

19. The make-before break selector switch of claim 15 wherein the blade is T-shaped.

20. The make-before-break selector switch of claim 15 wherein the blade is coupled to the selector switch control mechanism such that the blade is moveable to a third position in which the first electrical contact is not coupled to the second electrical contact or the third electrical contact.

* * * * *